United States Patent [19]

Labbe et al.

[11] 4,214,595

[45] Jul. 29, 1980

[54] CIGARETTE MAKING MACHINES

[75] Inventors: Francis A. M. Labbe, Neuilly-sur-Seine, France; Jan A. Rakowicz; Ronald A. Ahern, both of London, England

[73] Assignee: Molins Limited, London, England

[21] Appl. No.: 802,854

[22] Filed: Jun. 2, 1977

[30] Foreign Application Priority Data

Jun. 3, 1976 [GB] United Kingdom ..... 22902/76

[51] Int. Cl.[3] ..... A24C 5/18

[52] U.S. Cl. ..... 131/108; 131/109 B

[58] Field of Search ..... 131/110, 109 R, 109 B, 131/109 AB, 108, 20 R, 21 A, 21 B, 84 R, 84 A, 84 B, 84 C; 222/56, 64, 65; 414/294, 296

[56] References Cited

U.S. PATENT DOCUMENTS

| | | | |
|---|---|---|---|
| 1,873,779 | 8/1932 | Molins | 131/109 R |
| 3,276,452 | 10/1966 | Dearsley | 131/109 R |
| 4,036,239 | 7/1977 | Rakowicz | 131/109 R |
| 4,095,604 | 6/1978 | Labbe | 131/109 B |
| 4,121,596 | 10/1978 | Labbe et al. | 131/109 B |

FOREIGN PATENT DOCUMENTS

| | | | |
|---|---|---|---|
| 185294 | 7/1955 | Austria | 131/109 R |

*Primary Examiner*—V. Millin

*Attorney, Agent, or Firm*—John C. Smith, Jr.

[57] ABSTRACT

In the hopper of a cigarette making machine the tobacco slides down a ramp into a narrow downwardly extending channel situated at a position spaced from the area in the hopper which initially receives the tobacco. The tobacco is fed upwardly from that area by a spiked elevator band and is then removed from the spiked elevator band and transferred to the downwardly extending channel by further conveyor means.

34 Claims, 11 Drawing Figures

Fig. 6
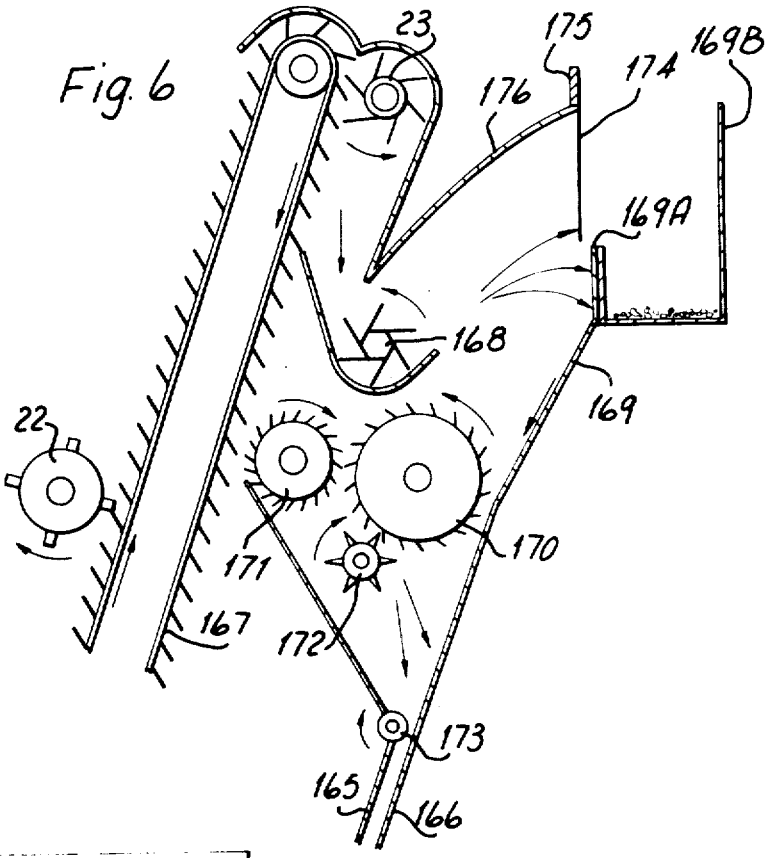
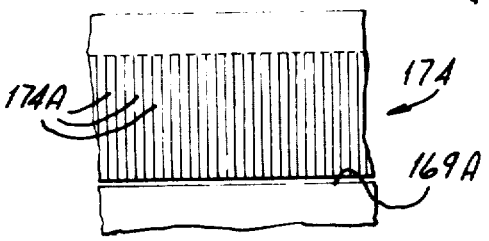
Fig. 7.

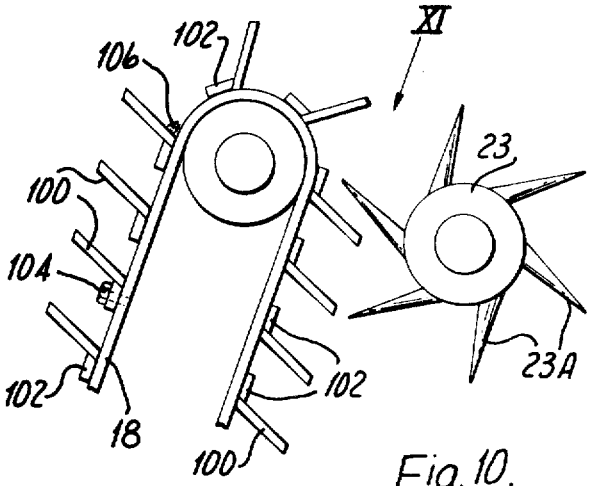
Fig. 10.
Fig. 11.
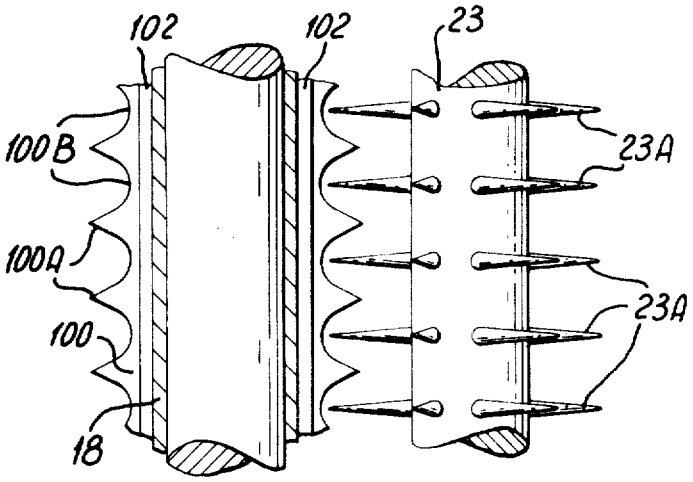

CIGARETTE MAKING MACHINES

This invention is concerned with the hoppers of cigarette making machines. The hopper of a cigarette making machine is used to form a metered flow of tobacco which may be received intermittently by the machine. The metered flow is converted, in another part of the machine, into a cigarette filler stream which is enclosed in a wrapper to form a cigarette rod.

In this context the term "tobacco" is intended to include tobacco substitutes; and the term "cigarette" is intended to include other similar rod-like articles for smoking, for example small cigars which are made in a similar manner to cigarettes.

There are various aspects to this invention which may be used separately or in any desired combination.

Our British Patent Application No. 37955/74 (and corresponding German Offenlegungsschrift and U.S. Pat. No. 4,121,596 25 38 334) to which reference is directed in its entirety, describes a hopper for a cigarette making machine which comprises means for feeding tobacco onto a ramp, a spiked conveyor which is mounted adjacent to but slightly spaced from the ramp so that it allows loose particles of tobacco to slide past it down the ramp, but picks up lumps of tobacco, and means for opening up the lumps of tobacco and for then delivering that opened up tobacco into the remainder of the tobacco. More specifically the above-mentioned specification describes an arrangement in which the opened up tobacco (i.e. what is derived by opening up the lumps of tobacco) is delivered onto the ramp below the spiked conveyor.

According to one aspect of the present invention, the opened up tobacco is instead delivered again onto the ramp above the spiked conveyor so that it again has to pass between the spiked conveyor and the ramp on its way to the next processing stage. This invention has the advantage that any lumps of tobacco which survive the opening up procedure can again be caught by the spiked conveyor, whereupon they are subject to a repeat of the opening up procedure, and this cycle repeats until the lumps are opened up sufficiently to pass between the ramp and the spiked conveyor.

According to another aspect of this invention a hopper for a cigarette making machine includes means for projecting the tobacco towards a wall in a direction such that the tobacco hits the wall while any heavy foreign bodies in the tobacco pass over the top of the wall so as to be separated from the tobacco, characterised by a curtain comprising a row of limp, downwardly hanging strands above the wall to arrest lumps of tobacco while allowing heavy foreign bodies to pass over the wall.

The curtain may be formed by a vertically hanging sheet of limp plastics material formed with a regularly spaced vertical slit extending from its bottom edge to near its top edge to form a row of narrow strip-like strands. Alternatively the strands may comprise lengths of string. In either case a small weight may be secured to the lower end of each strand to hold the strand lightly in tension.

According to another aspect of this invention, a hopper for a cigarette making machine includes a downwardly extending channel into which tobacco is delivered through the upper end to form a column of tobacco in the channel, tobacco being fed continuously from the lower end of the channel; a conveyor band running below the channel towards the front of the cigarette making machine and which receives the tobacco delivered from the lower end of the channel and is arranged to deliver the tobacco towards a filler forming device (for example, one which showers the tobacco towards a narrow band on which the tobacco forms a cigarette filler stream); a spiked elevator band lying in front of the channel and arranged to deliver a metered flow of tobacco from a space in front of the band into which incoming tobacco is delivered into the hopper; and means for removing the tobacco from the elevator band and for delivering it to the channel.

This hopper geometry is in contrast with the arrangement shown in FIG. 1 of our above-mentioned specification. The present arrangement leads to a more compact construction (particularly in regard to the height) and allows ready access to the channel from the back of the machine.

According to another aspect of this invention a hopper for a cigarette making machine includes a feed device for feeding a mass of tobacco towards an upwardly moving spiked or slatted conveyor which is arranged to carry a stream of tobacco from the mass of tobacco, including a roll detecting device comprising a roller which rests on the mass of tobacco and is rotatably carried by a movable carrier member, the roller being rotatable relative to the carrier member only in the direction produced by non-rolling movement of the tobacco mass towards the conveyor, whereby a rolling motion of the tobacco causes the roller to move the carrier member away from the conveyor, thus indicating that rolling is occurring.

Other aspects of hoppers according to the present invention can be appreciated from the following description with reference to the accompanying drawings. In this drawings:

FIGS. 1 to 6 and FIGS. 8 and 9 are diagrammatic sectional views from one side of eight different hoppers according to this invention;

FIG. 7 is a rear view of part of the stranded curtain shown in FIG. 6;

FIG. 10 is an enlargement of part of FIG. 1; and

FIG. 11 is a partly sectional view in the direction of the arrow XI in FIG. 10.

Figure 1:
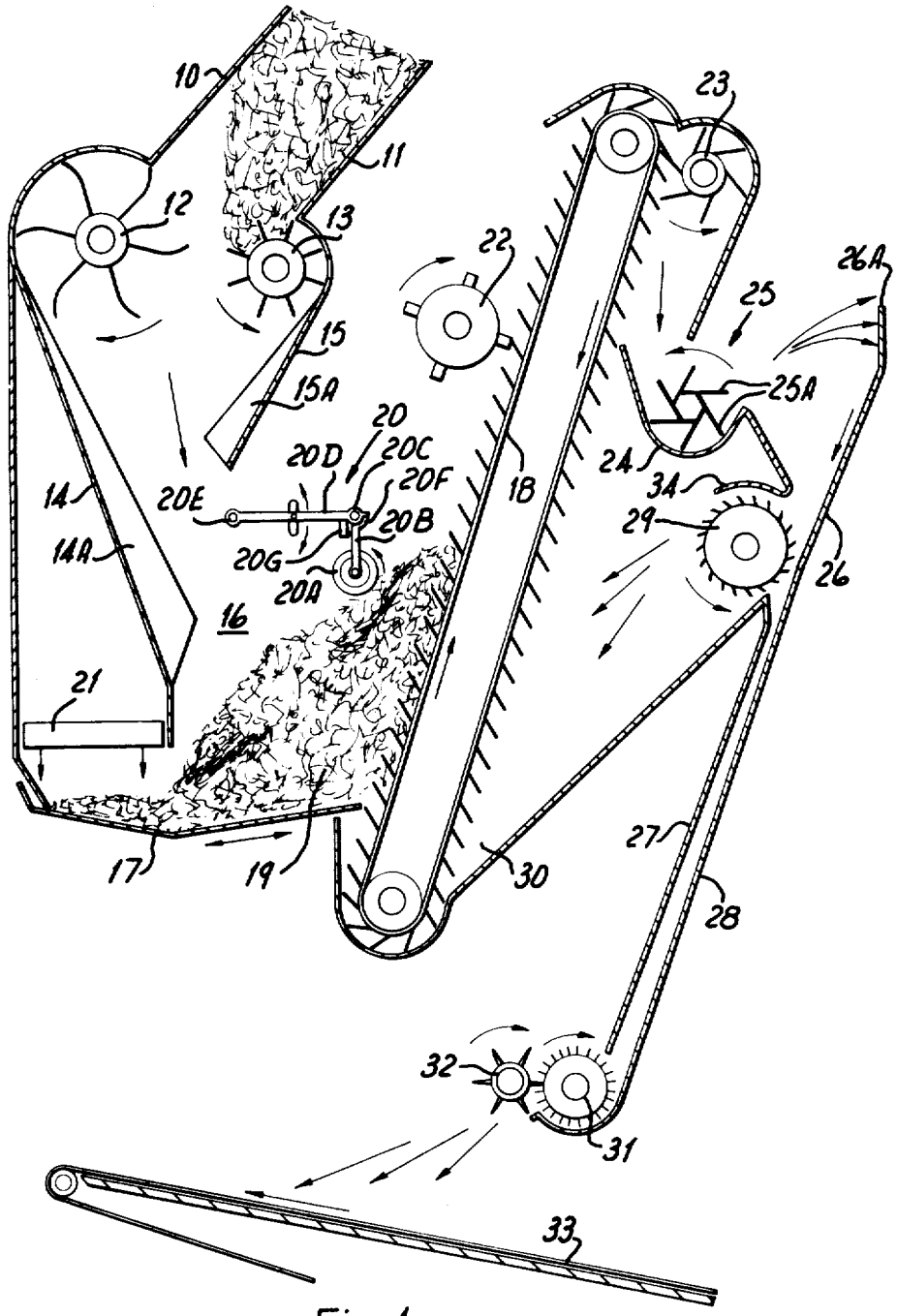

The hopper shown in FIG. 1 has parallel walls 10 and 11 defining a tobacco inlet channel extending obliquely downwards. The length of the channel is sufficient to accommodate a buffer store of tobacco, for example about 3 cubic feet. Tobacco may be fed into the upper end of the channel 10, 11 in any convenient way.

The angle of inclination to the vertical of the channel 10, 11 is such that the tobacco is just able to slide down when allowed to do so by a spiked roller 13; the angle could be even greater if the wall 11 is coated with a low friction material such as ultra-high molecular weight polyethylene. When the roller 13 rotates (in a counter-clockwise direction) it allows tobacco to drop from the lower end of the channel 10, 11; when the roller 13 stops rotating, it holds up the tobacco. As an additional safeguard (especially for "long" tobacco which tends to tangle up) there is a doffer roller 12 which may rotate continuously, for example at a speed of about 120 r.p.m. This manner of feeding tobacco minimizes degradation of the tobacco and is useful in its own right.

The width of the tobacco shower delivered by the channel 10, 11 (measured in the direction of the axes of rollers 12 and 13) may be changed (e.g. increased) as follows. Inclined side walls 14 and 15 are each formed with a number of downwardly extending vanes 14A and 15A; these vanes may, for example, diverge slightly in a downward direction if the tobacco shower is required to be increased. This may be necessary if the width of the tobacco discharge unit feeding the channel 10, 11 is less than the width of the eventual carpet of tobacco which the hopper is required to produce (on band 33).

A tobacco space 16 which receives the incoming tobacco is defined partly by a floor member 17 and partly by an upwardly moving spiked elevator band 18. The floor member 17 reciprocates (e.g. at about 50 cycles per minute) in the direction of the double-headed arrow with slow strokes towards the band 18 and fast return strokes, so as to feed the mass of tobacco 19 towards the band 18. A device 20 monitors the height of the mass of tobacco 19 and switches on and off the drive to the roller 13 in order to maintain the tobacco height within predetermined limits; the device 20 also serves as a roll detector, as described further on.

If tobacco is removed from the cigarette filler stream, that tobacco (which may be termed "discard tobacco") may be returned by a vibratory tray 21 which delivers the tobacco across the left-hand end of the floor member 17.

The construction of the spiked band 18 is shown in FIGS. 10 and 11 and will be described further on.

The elevator band 18 carries a substantially metered flow of tobacco from the mass 19 in an upward direction. Excess tobacco is knocked off the band by a doffer roller 22. The metered flow of tobacco is then removed from the band with the aid of an unravelling roller 23 which will be described further on with reference to FIGS. 10 and 11. The tobacco leaves the band 18 in a downward direction, arriving on a concave plate 24 along which the tobacco is projected by a projector roller 25 fitted with a number of circumferentially spaced plates 25A. The tobacco leaves the plate 24 in a direction and at a velocity such that heavy foreign bodies pass over the upper edge 26A of a ramp 26, while loose particles of tobacco and lumps of tobacco hit the ramp 26 and then slide down the ramp.

At the lower end of the ramp 26 there is a tobacco channel formed by walls 27 and 28 which diverge slightly in a downward direction (the amount of divergence being shown somewhat exaggerated). The wall 28 forms a smooth continuation of the ramp 26.

In order to enter the channel 27, 28, the tobacco must pass between the ramp 26 and a spiked drum 29. The arrangement is such that loose particles of tobacco can pass the drum and thus enter directly into the channel 27, 28, whereas lumps of tobacco are caught on the spikes of the drum 29 and are projected downwards in the approximate direction of the arrows towards a well 30 near the lower end of the downward-moving run of the band 18. The lumps are then conveyed further by the band 18, being joined on the band by further incoming tobacco drawn from the mass 19, and the lumps and tobacco are then removed by the unraveller roller 23. In the course of their removal by the roller 23 the lumps tend to be opened up so as to arrive back at the ramp 26 as loose particles of tobacco. However, any lump of significant size which survives this opening up process will be caught again by the spiked drum 29 and returned for a repeat of the opening up process.

Tobacco delivered into the channel 27, 28 builds up into a column (as described in our earlier-mentioned specification) of which the height is maintained within set limits, for example by controlling the speed of the band 18. A carded drum 31 feeds tobacco continuously from the lower end of the channel 27, 28, and a picker roller 32 removes the tobacco from the drum 31 and projects it onto a band 33 which carries the tobacco as a loose carpet towards a cigarette filler forming section of the machine (not shown).

The gap between the ramp and the tips of the spikes of the drum 29 is preferably slightly less than the minimum distance between the walls 27 and 28 to ensure that any lump that might be large enough to join between the walls 27, 28 is removed by the drum 29. The gap may be adjustable, e.g. by provision for horizontal adjustment of the drum 29.

A fixed curved plate 34 helps to ensure that the tobacco on the spiked drum 29 is projected into the well 30.

The drum 29 may rotate, for example, at a speed of about 250 r.p.m.

It should be understood that the band 33 moves in a direction towards the front of the machine where the cigarette filler forming part of the machine is normally located. In other words, the elevator band 18 is in front of the channel 27, 28, and the tobacco space 16 is in front of the elevator band. Accordingly, among other advantages, it is possible to obtain ready access to the back wall 28 of the channel 27, 28 from the back of the machine; such access may, for example, be needed in order to clear out tobacco from the channel in the event of a choke (i.e. tobacco jamming in the channel), for which purpose the wall 28 is readily removable, or in order to adjust the spacing between the walls 27 and 28 of the channel.

It should furthermore be noted that the lower end of the elevator band 18 is well below the upper end of the channel 27, 28. This is advantageous not only because it keeps the height of the machine to a minimum, but also because it allows ready access to the entire band 18 for an operator of normal height. Also, this ensures that the lower end of the tobacco entry channel 10, 11 is relatively low, so that a fairly long channel 10, 11 can be used to provide a substantial buffer capacity without the upper end of the channel 10, 11 being excessively high; in this connection it should be noted also that the inclination of the channel 10, 11 to the vertical (e.g. by about 45°) is desirable to minimise the total height.

The roll detector device 20 in the tobacco space 16 is as follows. It includes a roller 20A rotatably supported at opposite ends by a pair of levers 20B pivoted at 20C to horizontal levers 20D which are pivoted to a fixed frame member (not shown) at 20E. The pivots 20C allow the levers 20B to swing in a clockwise direction towards the levers 20D, but include stops 20F which prevent the levers 20B from swinging in an anti-clockwise direction beyond the position shown (i.e. approximately at right angles to the levers 20D). Furthermore, the roller 20A includes a unidirectional clutch of any known construction whereby it can rotate relative to the levers 20B only in a counterclockwise direction.

During normal operation, the movement of tobacco past the roller 20A rotates the roller in a counter-clockwise direction and holds the levers 20B against their stops. The levers 20D move up and down in response to the height of the tobacco below the roller 20A, and this movement is transmitted to a mechanism (not shown) which switches on and off or controls the speed of the drive to the feed roller 13 in order to maintain the height of the tobacco below the roller 20A between predetermined limits.

If the mass of tobacco 19 begins to roll through the action of the band 18, i.e. in a counter-clockwise direction, the movement of the tobacco relative to the roller 20A tends to rotate the roller 20A in a clockwise direction. However, in view of the unidirectional clutch in the roller 20A preventing such clockwise rotation, what happens is that the levers 20B are rotated in a clockwise direction about the pivots 20C. A switch 2G or other device detects such movement of the levers 20B and automatically introduces corrective action to stop the tobacco rolling. For example, the corrective action may consist of temporarily stopping or reducing the speed of reciprocation of the floor member 17; in the former case the drive for the floor member may, for example, be stopped for a predetermined time and then resume unless the switch or other device indicates that rolling is still occurring.

It should be noted that the roller 20A of the device 20 is fairly close to the elevator band 18 but is spaced from it so as not to intefere with the picking up of tobacco by the band.

Figure 3:
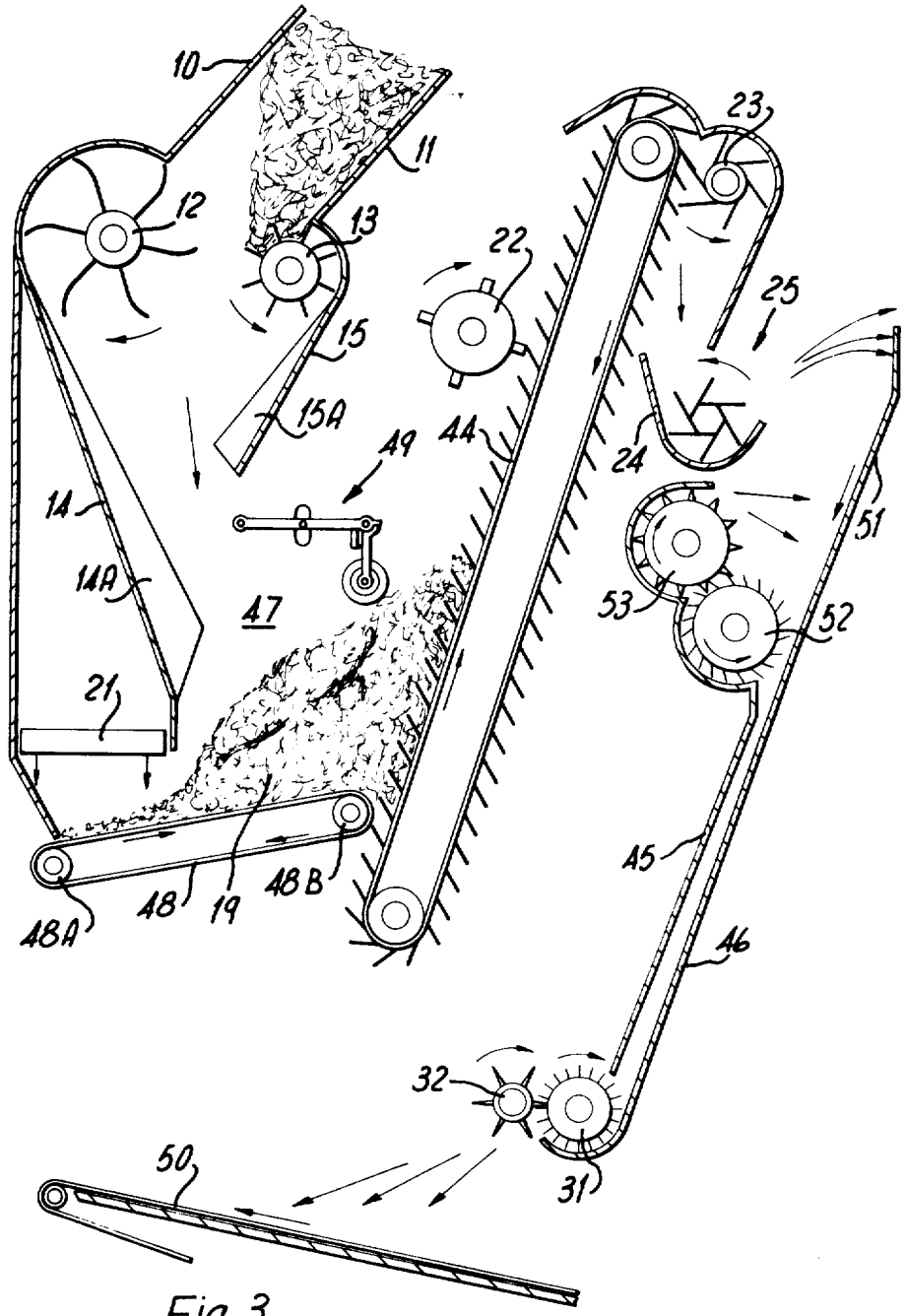

The reciprocating member 17 feeding the tobacco towards the elevator band 18 may be replaced by a band as shown, for example, in FIG. 3.

Instead of the projector roller 25 rotating in a counterclockwise direction, it may rotate clockwise. In that case it is so arranged and positioned that the tobacco delivered by the spiked band lands directly on top of the roller 25 and is immediately thrown towards the ramp 26 by ribs on the roller 25, which in this case are preferably radial.

Figure 2:
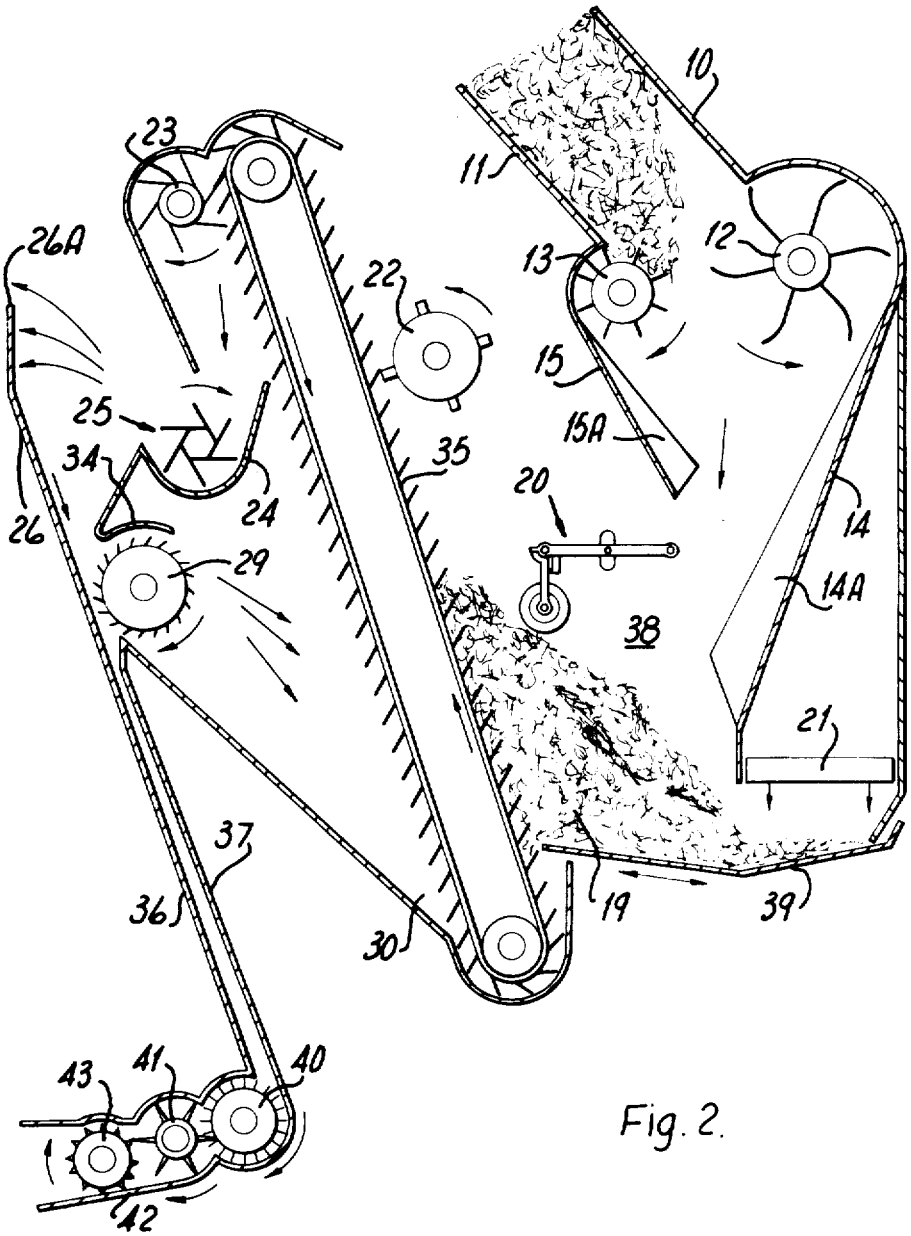

The hopper shown in FIG. 2 is generally similar to that shown in FIG. 1, except that it includes an elevator band 35 which is behind the channel defined by walls 36 and 37; and a tobacco space 38 from which the elevator band 35 receives tobacco is behind the elevator band. As in FIG. 1, there is a reciprocating floor member 39 which feeds the tobacco towards the elevator band. It should be noted that, as in FIG. 1, there is an obtuse angle between the floor member 39 and the band 35; that it to say, the floor member urges the tobacco towards the elevator band in a direction having a component in the direction of movement of the elevator band. Since the tobacco space 38 is behind the elevator band 35 in FIG. 2, the elevator band and the channel 36, 37 are inclined to the vertical in a direction opposite to that shown in FIG. 1. Other parts of the hopper are similar to that shown in FIG. 1 (and have similar reference numerals) and need no description, apart from the means for feeding tobacco from the lower end of the channel 36, 37.

In the FIG. 2 hopper, tobacco is fed continuously from the channel 36, 37 by a carded drum 40. A picker roller 41 strips the tobacco from the drum 40 and projects it along a plate 42, and an accelerator roller 43 with axial ribs projects the tobacco along the plate 42 at a controlled (possibly increased) speed so that the tobacco leaves the left-hand end of the plate 42 in a controlled direction and at a controlled velocity.

FIG. 3 shows a hopper which is similar to the FIG. 1 hopper in that it has an elevator band 44 in front of a tobacco channel 45, 46, tobacco being received by the band 44 from a tobacco space 47 in front of the band. However, in place of the reciprocating floor member 17 of FIG. 1 there is a conveyor band 48 which moves in a slightly upward direction and defines an obtuse angle with the elevator band 44. A tobacco height and roll detector device 49 (like the device 20 in FIG. 1) in this case may control the speed or switch on and off the drive to the band 48 when rolling of tobacco in the space 47 occurs.

As in FIG. 1, a fast-moving band 50 carries the final tobacco carpet towards the front of the machine where the cigarette filler forming section is located. It should be noted that the band 50 passes below the right-hand end of the band 48, so that any particles of tobacco which drop between the band 48 and the elevator band 44 fall onto the band 50.

Lumps of tobacco sliding down the ramp 51 are caught by a spiked drum 52, as in FIG. 1. However, in this example, the lumps are removed from the drum 52 by a picker roller 53 rotating at high speed, preferably variable (e.g. between say 400 r.p.m. and 800 r.p.m.). The picker roller tends to open up the lumps and projects the opened up tobacco back onto the ramp 51. The speed of the drum 52 may, for example, be 150 r.p.m.

Figure 4:
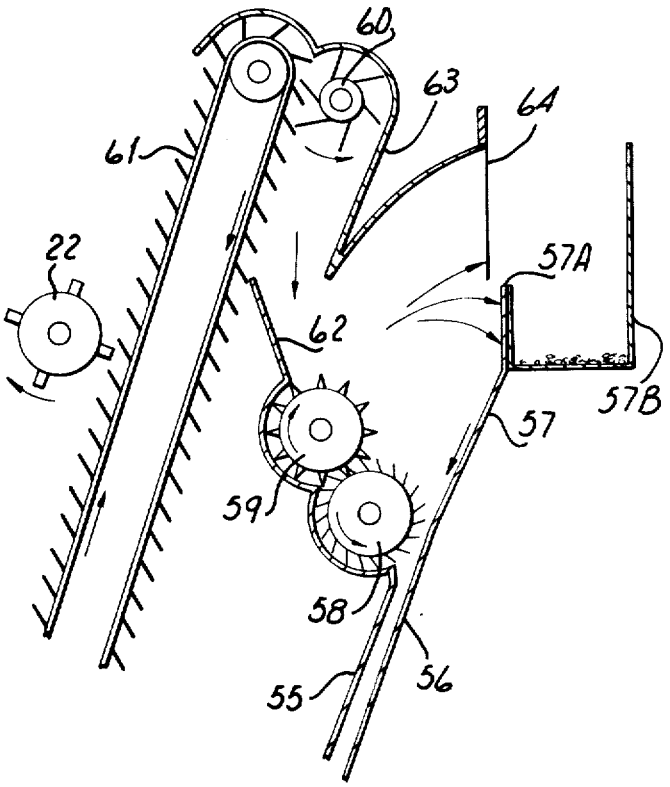

FIG. 4 shows a possible modification of part of FIG. 3. As in FIG. 3, tobacco enters a channel 55, 56 by sliding down a ramp 57 past a spiked drum 58. However, in this example, the tobacco is projected onto the ramp by the same picker roller 59 that removes (and opens up) the lumps from the drum 58. It will be noted that an unraveller roller 60 which removes tobacco from an elevator band 61 directs the tobacco downwards (with the aid of fixed walls 62, 63) onto the roller 59; on reaching the roller 59, the tobacco is immediately thrown towards the ramp 57 and does not pass around the roller 59. The drum 58 and roller 59 may, for example, rotate at speeds of 150 and 600 r.p.m. respectively.

Above the ramp 57 there is a curtain 64 formed by a row of closely spaced strands hanging slightly to the left of the top edge 57A of the ramp. Heavy foreign bodies such as stones can pass through the curtain and are collected in a box 57B. However, any lumps of tobacco which strike the curtain lose their momentum and fall to the left of the edge 57A of the ramp and then slide down the ramp.

A similar curtain arrangement may be included in the other examples described in this specification.

In FIGS. 1 and 3 the angle between the elevator band 18 or 44 and the floor member 17 or band 48 may be adjustable, for example, by making provision for adjustment of the floor member or band 48 about the end adjacent to the elevator band. The angle of inclination to the horizontal of the band or of the part of the member 17 adjacent to the elevator is preferably close to the friction angle in relation to the coefficient of friction between the tobacco and the band 48 or member 17. As a consequence the forward driving force applied to the tobacco by the band or member 17 cannot be excessive; the tobacco slips on the band or member 17 before that can occur. With this provision, the danger of tobacco rolling is minimized and it is possible to omit the roll detection facility of the device 20.

The surface of the floor member 17 or band 48 should preferably be of a material, for example that known by the trade name Nylon, which exhibits a fairly stable friction characteristic in relation to tobacco.

In FIG. 3, the band 48 may have one or more longitudinally extending ribs (for example of V or truncated V cross-section) on its inner face to engage circumferential grooves in the pulleys 48A and 48B supporting the band as an aid to tracking, i.e. maintaining the band on its proper course.

Figure 5:
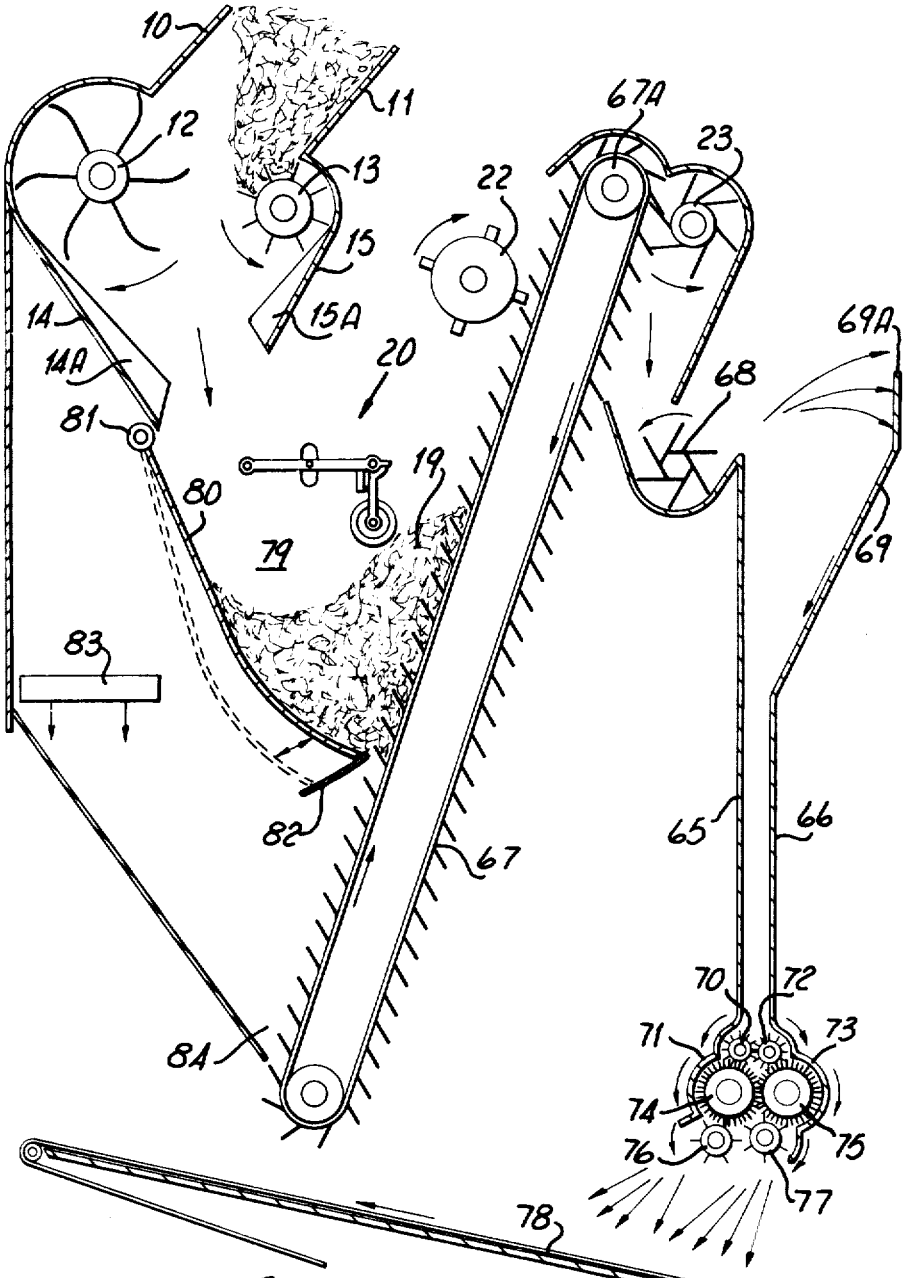

FIG. 5 shows a hopper which is similar to that shown in FIG. 1 in that it includes a channel 65, 66 which is behind the spiked elevator band 67. However, whereas the channel 27, 28 in FIG. 1 is intended to be relatively narrow (i.e. having a mean width between the front and back walls 27, 28 of between 14 and 22 mm), the channel 65, 66 in FIG. 5 is relatively wide. For example, the walls 65, 66 may be spaced apart at their upper ends by a distance which is adjustable between 23 and 35 mm, the spacing at the lower end being between 27 and 45 mm. In this case there is no need to extract and open up the lumps in the tobacco before the tobacco passes into the channel, since the channel is wide enough to accept lumps. Accordingly, tobacco received from the elevator band 67 is merely projected by a projector roller 68 towards a ramp 69 and slides down the ramp and into the channel 65, 66 while heavy foreign bodies pass over the top edge 69A of the ramp and are rejected.

Figure 8:
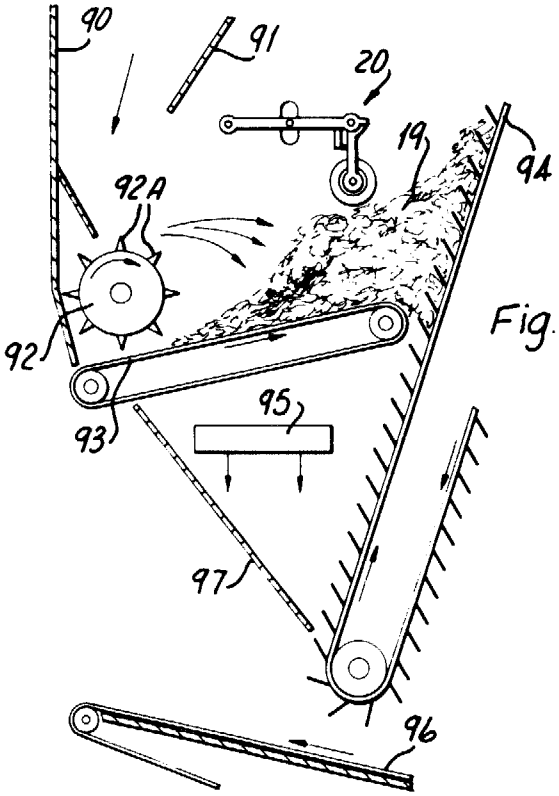

Tobacco is fed continuously from the lower end of the channel 65, 66 by a six-roller arrangement which is generally similar to that shown in FIG. 8 of our above-mentioned specification; that is to say, the tobacco stream leaving the channel 65, 66 is divided into two streams one of which passes between a roller 70 and a fixed wall 71 while the other passes between a roller 72 and a fixed wall 73. The two streams are received respectively by rollers 74 and 75 which have cooperating picker rollers 76 and 77 which project the tobacco downwards onto a band 78, producing a spread shower along the band as indicated by the arrows.

Tobacco is received by the elevator band 67 from a tobacco space 79 defined partly by an oscillating plate 80. The plate 80 oscillates, with slow strokes towards the elevator and fast return strokes, about a horizontal pivot axis 81 at its upper end so as to feed tobacco onto the elevator band 67. A fixed plate 82 is positioned adjacent to the lower end of the plate 80 so as to stop large quantities of tobacco falling down from the space 79 while the lower end of the plate 80 is spaced from the band 67.

Discard tobacco may be fed by a vibrating tray 83 into a well 84 near the lower end of the upward-moving run of the band 67. Alternatively, as shown in FIG. 9, an oscillating plate 85 may be provided (in place of the plate 80) near the lower end of an elevator band 86, in which case the discard tobacco may be returned by a vibrating tray or other tobacco conveyor 87 into the space 88 which receives the incoming tobacco.

Instead of being pivoted about a fixed axis at 81, the oscillating plate 80 may be suspended at its upper end by a number of springs so that the upper end can move at least to a limited extent in a horizontal direction. As a result, movement of the plate 80 towards and away from the elevator band 67 is less positive, having slight flexibility as a result of the spring suspension. The mean position and/or stroke of the plate 80 or 85 may in either case be adjustable.

Figure 9:
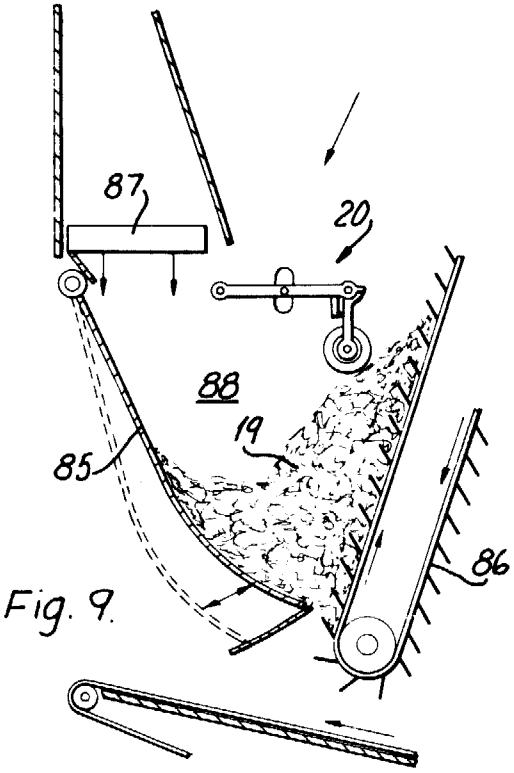

The oscillating plate 80 or 85 in FIG. 5 or FIG. 9 may have a low-friction coating on its face contacting the tobacco. For example, the coating may be of ultra-high molecular weight polyethylene.

In order to accommodate different tobacco, the assembly comprising the elevator band 67, its associated pulleys, and possibly the refuser roller, may be adjustable about the axis of the upper pulley 67A to adjust the angle of inclination to the vertical of the band 67, e.g. between limits of 15° and 25°. The mean position of the oscillating plate 80 would in that case be adjusted as appropriate.

FIG. 6 shows a modification of part of the hopper shown in FIG. 1. As in FIG. 1, a tobacco channel 165, 166 is mounted behind the elevator band 167. Also as in FIG. 1, tobacco is projected by a projector roller 168 towards a ramp 169, so that heavy foreign bodies pass over the top of the ramp and must pass between the ramp and a spiked drum 170 in order to enter directly into the channel 165, 166. Lumps are caught on the spikes of the drum 170 and are opened up by means of a refuser roller 171 and a picker roller 172; the picker roller projects the opened up tobacco downwards towards the inlet to the channel 165, 166. A roller 173 may be included at the inlet to the channel 165, 166 to assist entry into the channel of stiff pieces of tobacco or small lumps. The back 166 of the channel 165, 166 forms a smooth continuation of the ramp 169.

A curtain 174 and box 169B are provided, as in FIG. 4. The curtain comprises a sheet of plastic material which is carried by a support rail 175 and is slit vertically from its lower edge to produce strips 174A (see FIG. 7). A cover plate 176 ensures that no foreign bodies can pass over the curtain. The curtain hangs slightly in front of the top edge 169A of the ramp, the bottom edge of the curtain being slightly above the edge 169A.

FIG. 8 shows a modification of part of the hopper shown in FIG. 3. Walls 90, 91 (which may have vanes like the vanes 14A and 15A identified in FIG. 1) guide tobacco which is fed downwards (e.g. from feed rollers 12 and 13 as in FIG. 1) onto a projector roller 92 formed with a number of circumferentially spaced axial ribs 92A. The tobacco arrives at somewhat random positions across the width of the roller 92 and is accordingly projected along varying trajectories onto the band 93 feeding the tobacco towards an elevator band 94; as a result of the varying trajectories of the tobacco, the tobacco tends to be spread somewhat along the length of the band 93, thus helping to maintain a layer of tobacco of substantially uniform thickness on the band 93 in the region of the elevator band 94. The thickness of the layer of tobacco presented by the band 93 to the elevator may, for example, be in the region of 100 mm to 225 mm. Discard tobacco may be returned by a vibrating tray conveyor 95 to the lower end of the elevator band 94. As in other hoppers shown in the accompanying drawings, the band 96 delivering the final carpet of tobacco passes below the elevator 94 so that any particles of tobacco which drop between the elevator 94 and a fixed wall 97 fall onto the band 96.

FIG. 10 is an enlargement in the region of the upper end of the elevator band 18 in FIG. 1. It shows the construction of the elevator band and of the associated unraveller roller 23. The elevator bands and unraveller rollers in the other examples may be similar.

The band 18 has transversely extending rows of spikes 100A (see FIG. 11) formed by metal slats 100 which have recesses 100B at regular intervals along the outer edges of the slats so as to leave spike portions 100A between the recesses. Each slat is carried by a metal strip 102 which is secured to the band 18, e.g. by bolts 104.

The unraveller roller 23 has a number of axially spaced groups of spikes 23A, each group comprising six spikes. The spikes enter the recesses 100B of the slats on the band, as shown in FIG. 11. It will be understood that the recesses in successive slats are aligned for that purpose.

The inner rib-like portions of the slats adjacent to the band 18 serve as pockets which can convey upwards small particles of tobacco which spikes alone cannot convey. By way of example, a cluster 106 of such particles of tobacco is shown in FIG. 10. It will be understood that the small particles of tobacco fall from the band 18 towards the projector roller 25 at the same time as larger strands of tobacco are stripped from the band with the aid of the unraveller roller 23.

The feed roller 13 may have spikes formed by recessed slats similar to the slats 100 shown in FIG. 9. On the other hand, the doffer roller 12 may have non-recessed slats curved backwards relative to the direction of rotation, as shown in FIG. 1.

By way of example, the slats 100 on the band 18 may be at about 20 mm intervals. However, in order to reduce the tendency for tobacco to roll in the tobacco space adjacent to the elevator band, occasional slats may be omitted. For example, every fourth slat may be omitted.

In all the hoppers shown in the accompanying drawings, the speed of the elevator band may be controlled stepwise so as to be either a predetermined percentage above or a predetermined percentage below the mean speed in response to a photo-cell or other device monitoring the height of the tobacco column in the channel 27, 28 etc; for example, the predetermined percentage may be between 10% and 15%. The object, as already mentioned, is to maintain the height of the column within predetermined limits. Moreover, the mean speed of the elevator band may be subject to automatic control. Such control at any given moment of time may respond to the accumulated total of periods of fast operation and slow operation which have occurred during the past N minutes (or may respond to a running comparative count of the number of fast and slow periods of operation) and may vary the mean speed so as to maintain the ratio of fast operations to slow operations within predetermined limits. For example, the accumulated periods of slow operation may be kept between 30% and 50% of the total.

In the hoppers shown in FIGS. 1 to 4 and FIG. 6, the spiked drum 29, 52, 58 or 170 may, for example, be set with the tips of its spikes at a distance from the corresponding ramp which is approximately two thirds of the thickness of the upper end of the corresponding channel, (e.g. channel 27, 28 in FIG. 1). For example, those dimensions may respectively be 10 mm and 15 mm and the channel walls may diverge to give a channel-thickness at the bottom end of 17 mm. The position of the spiked drum relative to the ramp may be set so that about 20 to 25% of the tobacco delivered onto the ramp is picked up by the spiked drum so as to be recirculated.

We claim:

1. In a hopper for a cigarette making machine comprising means defining a downwardly extending channel, means for delivering tobacco through the upper end of said channel to form a column of tobacco in the channel, means for continuously feeding tobacco from the lower end of the channel, filler forming means spaced from one side of said channel, conveyor means running below said channel and from said one side thereof towards said filler forming means for receiving the tobacco delivered from the lower end of the channel and feeding the tobacco in a direction away from said one side of said channel to said filler forming means, elevator conveyor means at said one side of said channel, said elevator conveyor means being positioned between said channel on one side of said elevator means and a space on the opposite side of said elevator conveyor means and being arranged to deliver a metered flow of tobacco from said space on the side of said elevator conveyor means opposite said channel and into which incoming tobacco is delivered into the hopper, and means for removing tobacco from said elevator conveyor means and for delivering it to said channel.

2. A hopper according to claim 1 wherein said elevator conveyor means is elongated and the height of the upper end of said downwardly extending channel is at a substantially higher elevation then the lower end of said elevator conveyor means.

3. A hopper according to claim 1 further comprising further conveyor means positioned on said side of said elevator conveyor means opposite said channel for conveying the tobacco towards said elevator conveyor means.

4. In a hopper for a cigarette making machine comprising an upwardly moving conveyor means, feed means for feeding a mass of tobacco towards said upwardly moving conveyor means, roll detecting means comprising a roller adapted to rest on the mass of tobacco and a movable carrier member rotatably supporting said roller, the roller being rotatable relative to the carrier member only in the direction produced by non-rolling movement of the tobacco mass towards the upwardly moving conveyor means, whereby a rolling motion of the tobacco causes the roller to move the carrier member away from the upwardly moving conveyor means, thus indicating that rolling of the tobacco is occurring.

5. A hopper according to claim 4 further comprising means connected to said feeding means and responsive to movement of the carrier member indicating the onset of rolling to slow down or stop said feeding means.

6. A hopper according to claim 5 in which said movable carrier member is also movable up and down in response to the varying height of the mass of tobacco to detect the height of the tobacco.

7. A hopper according to claim 4 in which said movable carrier member is also movable up and down in response to the varying height of the mass of tobacco to detect the height of the tobacco.

8. In a hopper for a cigarette making machine an upwardly moving conveyor means for carrying a stream of tobacco from a mass of tobacco, further conveying means for conveying said mass of tobacco in an approximately horizontal direction towards said conveyor means, and roll detecting means, connected to said conveying means, for detecting the onset of a rolling motion of the mass of tobacco on said further conveying means caused by the upward movement of said conveyor means, and for temporarily stopping or reducing the speed of said further conveying means to obviate said rolling motion.

9. A hopper according to claim 8 in which said roll detecting means comprises a roller which rests on said mass of tobacco on said conveying means and a movable carrier member rotatably supporting said roller, said roller being rotatable relative to said carrier member only in the direction produced by non-rolling movement of said tobacco towards said conveying means, whereby a rolling motion of the mass of tobacco causes the roller to move the carrier member away from said conveyor means.

10. A hopper according to claim 9 further comprising tobacco delivery means for delivering tobacco onto said further conveying means, and means for detecting the quantity of tobacco on said conveying means and for controlling the operation of said tobacco delivery means for maintaining said quantity substantially constant.

11. A hopper according to claim 10 in which said roll detecting means is movable up and down in response to variations in height of said mass of tobacco on said further conveying means to detect the quantity of tobacco on said further conveying means.

12. A hopper according to claim 8 further comprising tobacco delivery means for delivering tobacco onto said further conveying means, and means for detecting the quantity of tobacco on said conveying means and for controlling the operation of said tobacco delivery means for maintaining said quantity substantially constant.

13. A hopper according to claim 12 in which said roll detecting means is movable up and down in response to variations in height of said mass of tobacco on said further conveying means to detect the quantity of tobacco on said further conveying means.

14. A hopper according to claim 8 in which said conveyor means comprises an elevator band which is inclined away from said mass of tobacco on said further conveying means, and in which said further conveying means is arranged to convey said tobacco mass in a slightly upward direction towards said elevator band.

15. In a hopper for a cigarette making machine including conveyor means adapted to move upwardly, controllable feed means for feeding a mass of tobacco approximately horizontally towards said upwardly moving conveyor means, whereby said conveyor means carries a stream of tobacco upwards from said mass of tobacco, and roll detecting means for detecting the onset of a rolling motion of said mass of tobacco on said feed means caused by said upward movement of said conveyor means and for temporarily stopping or reducing the speed of said feed means to obviate said rolling motion.

16. A hopper according to claim 15 in which said feed means comprises further conveyor means arranged to convey a thick carpet of tobacco of substantially uniform height towards said upwardly moving conveyor means.

17. In a hopper for a cigarette making machine a tobacco conveyor band adapted to move upwardly, feed means for feeding a mass of tobacco towards said band, discard return means for returning into the hopper discard tobacco removed from a cigarette filler stream, means mounted below said feed means for receiving said discard tobacco and for feeding said discard tobacco onto said band at a position upstream of the position said band receives tobacco from said mass of tobacco, and means for receiving from said band the combined discard and other tobacco and for delivering said combined tobacco to a cigarette filler forming device.

18. A hopper according to claim 17 in which said means for receiving said combined discard and other tobacco comprises means defining a downwardly extending channel in which said tobacco accumulates to form a column, a further conveyor band arranged to pass below said upwardly moving band and means for feeding tobacco continuously from the lower end of said column onto said further conveyor band whereby any discard tobacco which escapes between said discard tobacco receiving means and said upwardly moving band falls onto said further conveyor band.

19. In a hopper for a cigarette making machine, elevator conveyor means arranged to pass along a path past a mass of tobacco positioned adjacent a first position along said path, said elevator conveyor means being adapted for receiving and feeding a stream of tobacco from said mass of tobacco, means for feeding into said hopper discard tobacco removed from a cigarette filler stream in said cigarette making machine and for feeding the discard tobacco onto said elevator conveyor means at a second position along said path upstream of said first position before said elevator conveyor means receives tobacco from said mass of tobacco, and means for receiving from said elevator conveyor means the combined discard tobacco and tobacco from said mass of tobacco and for delivering said combined tobacco to a cigarette filler forming device in said cigarette making machine.

20. A hopper according to claim 14 in which said elevator conveyor means comprises a spiked band having an upwardly moving run.

21. A hopper according to claim 20 further comprising means for feeding said mass of tobacco towards said elevator conveyor means adjacent said first position along said path.

22. A hopper according to claim 21 wherein said means for feeding said mass of tobacco towards said elevator conveyor means comprises an approximately horizontal conveyor.

23. A hopper according to claim 20 in which said means for feeding discard tobacco is arranged to feed said discard tobacco onto an upwardly moving run of said elevator band at said second position along said path below said first position of said mass of tobacco.

24. A hopper according to claim 23 further comprising means for feeding said mass of tobacco towards said elevator conveyor means adjacent said first position along said path.

25. A hopper according to claim 24 wherein said means for feeding said mass of tobacco towards said elevator conveyor means comprises an approximately horizontal conveyor.

26. A hopper according to claim 23 further comprising a wall extending obliquely downwardly towards said upwardly moving run of said elevator band forming a space therebetween at said second position, said means for feeding said discard tobacco being arranged to deliver said discard tobacco into said space.

27. A hopper according to claim 26 in which said means for feeding discard tobacco into said hopper includes further conveyor means which is arranged to deliver said discard tobacco onto said downwardly inclined wall, near the upper end of said wall, from which position said discard tobacco can slide down said wall towards said elevator band.

28. A hopper according to claim 27 in which said means for feeding discard tobacco includes a vibratory tray extending across the upper portion of said downwardly inclined wall.

29. A hopper according to claim 26 including further conveyor means for receiving said combined discard tobacco and tobacco from said mass of tobacco from said elevator band and for feeding said combined tobacco towards said filler forming device, said further conveyor means being arranged to pass below said elevator band and to receive any discard tobacco which escapes between said downwardly inclined wall and said elevator band.

30. A hopper according to claim 26 in which said upwardly moving run of said elevator band is inclined to the vertical in a direction away from said downwardly extending wall.

31. A hopper according to claim 30 in which said means for feeding discard tobacco into said hopper includes further conveyor means which is arranged to deliver said discard tobacco onto said downwardly inclined wall, near the upper end of said wall, from which position said discard tobacco can slide down said wall towards said elevator band.

32. A hopper according to claim 31 in which said means for feeding discard tobacco includes a vibratory tray extending across the upper portion of said downwardly inclined wall.

33. A hopper according to claim 14 further comprising means for feeding said mass of tobacco towards said elevator conveyor means adjacent said first position along said path.

34. A hopper according to claim 33 wherein said means for feeding said mass of tobacco towards said elevator conveyor means comprises an approximately horizontal conveyor.

* * * * *